US011105122B2

(12) United States Patent
Dingemans et al.

(10) Patent No.: US 11,105,122 B2
(45) Date of Patent: Aug. 31, 2021

(54) MECHATRONIC LOCK SYSTEM

(71) Applicant: Bold Security Technology B.V., Tilburg (NL)

(72) Inventors: Antonius Dingemans, Tilburg (NL); Thomas Van Beek, Tilburg (NL); Jodi Kooijman, Tilburg (NL)

(73) Assignee: Bold Security Technology B.V., Tilburg (NL)

( * ) Notice: Subject to any disclaimer, the term of this patent is extended or adjusted under 35 U.S.C. 154(b) by 0 days.

(21) Appl. No.: 16/612,169

(22) PCT Filed: May 9, 2018

(86) PCT No.: PCT/NL2018/050305
§ 371 (c)(1),
(2) Date: Nov. 8, 2019

(87) PCT Pub. No.: WO2018/208154
PCT Pub. Date: Nov. 15, 2018

(65) Prior Publication Data

US 2020/0157846 A1 May 21, 2020

(30) Foreign Application Priority Data

May 9, 2017 (NL) ..... 2018876

(51) Int. Cl.
*G07C 9/00* (2020.01)
*E05B 47/00* (2006.01)
*E05B 47/06* (2006.01)

(52) U.S. Cl.
CPC ..... *E05B 47/0012* (2013.01); *E05B 47/0615* (2013.01); *G07C 9/0069* (2013.01);
(Continued)

(58) Field of Classification Search
CPC ..... G07C 9/00
See application file for complete search history.

(56) References Cited

U.S. PATENT DOCUMENTS 9,672,674 B2 * 6/2017 Meganck ..... E05B 3/06
9,805,534 B2 * 10/2017 Ho ..... G07C 9/00563
(Continued)

FOREIGN PATENT DOCUMENTS

| | | | |
|---|---|---|---|
| DE | 102006045195 | B3 | 4/2008 |
| EP | 0361881 | A2 | 4/1990 |
| NL | 2018222 | A | 4/2017 |

OTHER PUBLICATIONS

International Search Report for International Application No. PCT/NL2018/050305, dated Jul. 18, 2018 (4 pages).

*Primary Examiner* — K. Wong
(74) *Attorney, Agent, or Firm* — Nixon Peabody LLP

(57) ABSTRACT

The present invention relates generally to mechatronic locks and more specifically, wireless mechatronic smart lock systems for locking doors which can be activated through a rotational movement of the outer knob. In an aspect, the present disclosure describes a specific user interaction method and technical solution for activating the lock system. The user applies a predetermined or programmable motion pattern of rotational movements or motion pattern of the outer knob. The input movements or motions are detected by a sensor and matched with reference motion pattern descriptions by the intelligent controller in the lock system. Upon a positive match the lock system will be activated.

12 Claims, 2 Drawing Sheets

(52) U.S. Cl.
CPC ..... *G07C 9/00817* (2013.01); *G07C 2009/00825* (2013.01)

(56) References Cited

U.S. PATENT DOCUMENTS

| | | | | |
|---|---|---|---|---|
| 9,852,562 | B2 * | 12/2017 | Belhadia | G07C 9/00571 |
| 2012/0024024 | A1 | 2/2012 | Faber | |

* cited by examiner

Fig. 1 (100)
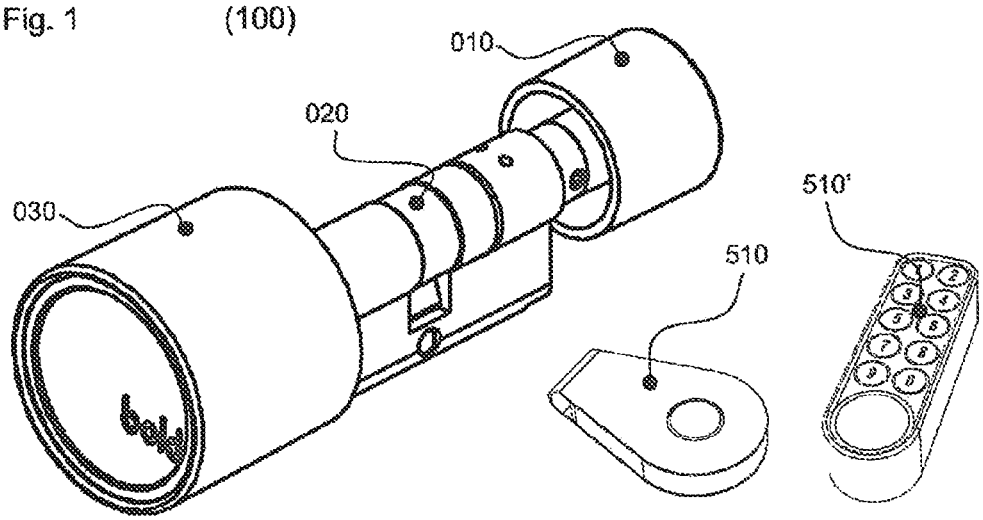
Fig. 2 (001)
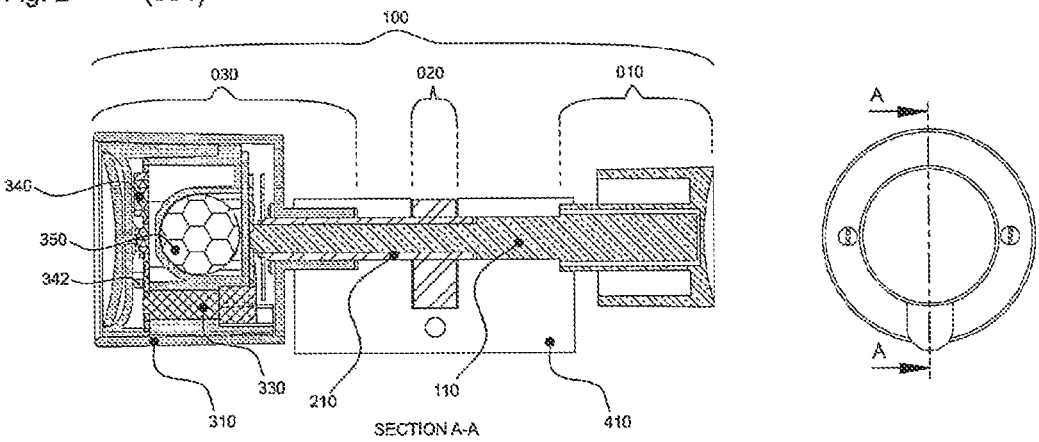
Fig. 3 (002)
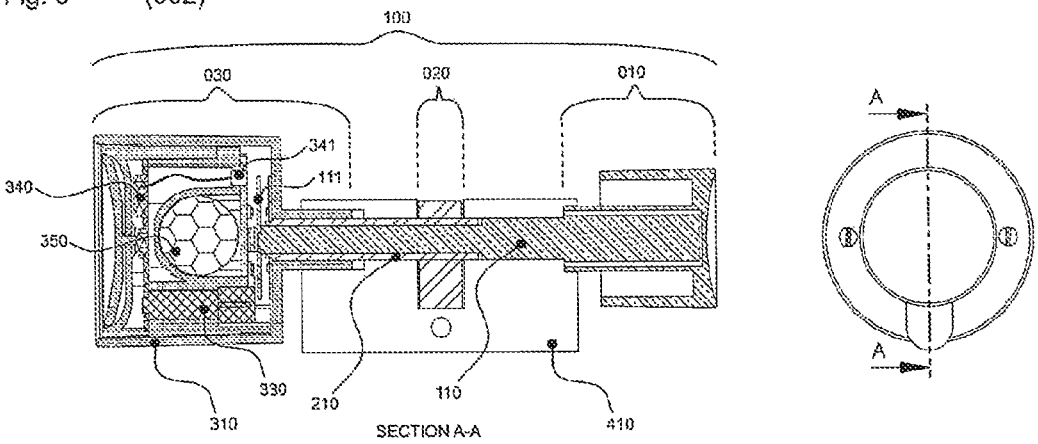

Fig. 4a Code '1234' direction modulated:
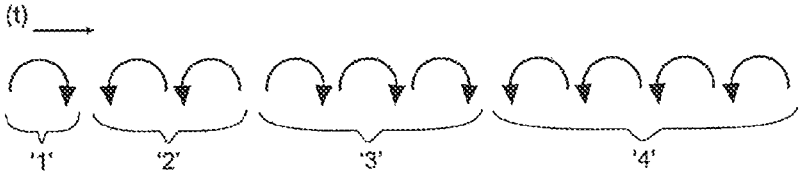
Fig. 4b Code '1234' time modulated:
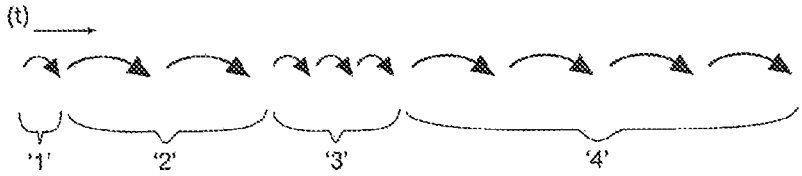
Fig. 4c Code '1234' intensity modulated:
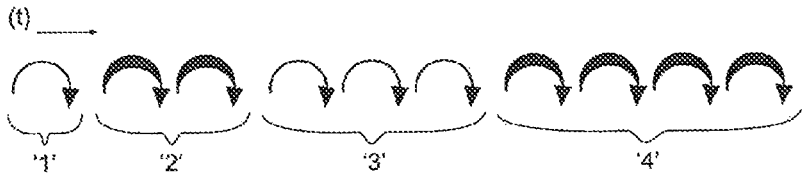
Fig. 4d Code '1234' discrete:
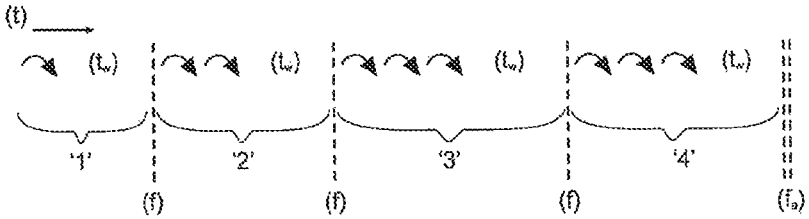

MECHATRONIC LOCK SYSTEM

CROSS-REFERENCE TO RELATED APPLICATION

This application is a national stage of Application No. PCT/NL2018/050305 filed May 9, 2018, which claims priority from Netherlands Application No. 2018876 filed May 9, 2017, which are both incorporated by reference in their entireties.

TECHNICAL FIELD

The present invention relates generally to mechatronic locks and more specifically, and preferably, wireless mechatronic smart lock systems for locking doors which can be activated through a rotational movement of the outer knob.

BACKGROUND OF THE INVENTION

Mechatronic locks are common in professional spaces. They are typically operated by badges, keyfobs or entering a PIN-code. A new category of mechatronic locks, typically referred to as smart locks, is operated by using a wireless personal handheld device e.g. a smartphone, smart watch or any other mobile or portable device. The latter is especially proving advantageous in home and 'Small and Medium Size Enterprises' (SME) applications. Nevertheless, solely relying on smartphone operation is not preferred as the smartphone battery can be empty or the smartphone can get stolen, lost, forgotten or temporarily unavailable, leaving the user locked out.

There are many options to create a backup solution. For example, one can temporarily grant access to a neighbor's smart phone, use a dedicated remote control, install a backup numeric keypad or biometric identification device on the door frame etc. Such backup options however require additional (dedicated) hardware.

The disclosed invention resembles a rotary combination lock user interface but differs in some essential aspects. Rotary combination locks of many sorts often use alphanumeric or other symbols in combination with the knob's rotational position as user input.

The present disclosed invention describes the combination of a novel user interaction with a specific lock system. This combination is suitable for creating new lock products as well as standardized cylinder locks, rim locks or deadbolt locks.

Mechatronic lock systems are known and widely applied in various access control applications with a main advantage, compared to conventional mechanical locks, in flexibility of access control configuration over time and encompassing large numbers of users.

Wireless mechatronic lock systems with an incorporated battery are especially advantageous as they do not require any (re)wiring and can communicate with different types of wireless communication devices. Access control using company badges has been widely adopted in professional applications.

A wireless mechatronic lock system is for example known from DE 102006045195 B3. In this publication a lock is disclosed wherein an input method is used through predetermined subsequent steps of 1) turning the outer knob into specific distinct angular positions which each are followed by 2) a separate confirming user action.

Such a system has several disadvantages. One of these disadvantages is that electronic components e.g. sensors, buttons and the like need to be added in the outer knob in order to detect the distinct angular position of the outer knob and for the confirming user action. Furthermore, electronics in the outer knob will be subject to and should therefore be protected against weather and other environmental conditions, vandalism and deliberate mechanical and electronic tampering attempts. Such protection functions result in a significant increase in cost and complexity and will adversely affect robustness in operation and digital and mechanical security.

Alternatively, a user push button action could be relayed mechanically through the lock system to the inner knob assembly. Such a solution also comes at significant increase of cost and complexity while decreasing robustness and especially the mechanical security level. However, even though this might be a suitable alternative for a double controlled lock system, with both the inner and the outer knob on one drive shaft and the cam being coupled and decoupled separately, it will be extremely difficult to create a single controlled variant due to the fact that both knobs are then rotating freely relative to each other. Finally, a late-stage configurable lock system will be even more difficult if not impossible to create.

Moreover, wireless mechatronic locks are typically operated by badges, keyfobs or other wireless controlled elements. As a backup, such locks are preferably also operable by entering a PIN-code or through other types of user interfaces which do not require additional wireless equipment. A disadvantage of known lock systems with such backup user interfaces is that such a user interface not only provides feedback to the user, e.g. about how the code should be entered or if the inputted code is correct, but also provide indications that give details about the code itself. If for example a code can be entered through a keypad having only 5 keys, security details about the code are inherently disclosed thereby which thus lower the level of security that the lock system may provide.

SUMMARY

It's therefore an objective of the described invention to provide an improved mechatronic lock system which obviates at least some of the above-mentioned drawbacks.

It's yet a further objective of the described invention to provide an improved mechatronic lock system which is able to maintain a high level of security by providing as little feedback as possible to the user by its user interface.

An advantage of wireless mechatronic locks compared to wired electric locks is the lower total cost of installation because there is no need to pull wires in the application.

To even further ease and lower manual labour for a first install or lock retrofit it is advantageous to comply to standard lock interfaces and retrofit installation methods.

For example, by using existing standardized cylinder or deadbolt lock interfaces. The present invention, in all aspects, provides such a retrofit solution with the same methods and effort as replacing conventional mechanical locks.

Known wireless mechatronic locks may be operated by letting the user apply a predetermined sequence or code sequence which consists of a series of rotational positions of the outer knob. The inventor however realized that this user interaction has a number of disadvantages, especially the feedback that is provided to the user through the user interface which not only reveals the fact that a user interface is present as backup system to the wireless control, but also has a negative effect on the level of security since information about the code such as length, suitable characters, etc. are revealed through the user interface.

The present disclosed invention, describes a specific user interaction method and technical solution for activating the lock system. The user applies a predetermined or programmable motion pattern of rotational movements or motion pattern to the outer knob. The movements or motions are detected by a sensor and matched with reference motion pattern descriptions by the intelligent controller in the lock system. Upon a positive match the lock system will be activated.

Hence, in a first aspect of the invention, a mechatronic lock system arranged for actuating a door lock upon activation of the system comprising:

- an outer knob, arranged for inputting a code sequence by a user of the lock system through rotation of the outer knob to activate the system;
- a sensor, arranged for determining a rotational movement of the outer knob;
- a control module in communicative connection with the sensor and arranged for defining an input motion pattern from the rotational movement, and wherein the control module is arranged for comparing the input motion pattern with a predetermined reference motion pattern and activating the system upon a match between the input motion pattern and the reference motion pattern, and wherein the motion patterns comprise a first and/or higher order time derivative of angular displacement of the outer knob.

The lock system according to the first aspect of the invention uses a motion pattern comprising at least one of a first and/or higher order time derivative of the angular position or angular displacement of the outer knob.

The rotational motion pattern consists for example of a sequence of distinct rotational movements of the outer knob. It is important that the user actions can be derived from an intellectual code that can be easily shared.

Contrary to the user interaction methods of the known wireless mechatronic lock systems, the present invention proposes the use of a relative motion patterns of the outer knob, whereas known systems are all directed to the fact that eventually a position of the outer knob is determined, either by directly determining the position, or by counting steps in a discrete angular displacement.

As an example, the code '1234' could mean one turn clockwise, two turns counter clockwise, three turns clockwise and four turns counter clockwise. According to the disclosed invention the angular displacement of each turn is not used in determining the rotational motion pattern. The rotational motion pattern alone is sufficient to activate the lock system. No additional confirmation user action is required, although in all examples, the actual physical release by the user of the outer knob could be used to distinguish between items of the code.

An advantage of the proposed system is that sensing components, i.e. sensors, may be located in the inner knob solely. No discrete rotational mechanical steps, symbols or buttons and related electronics are required. Hence, all elements that relate to the absolute positioning of the outer knob, become superfluous.

Furthermore, it is not relevant for the present invention to determine the absolute angular position of the outer knob in deriving the motion pattern.

The known systems, due to the fact that such systems ultimately define an absolute position of the outer knob, require facilities to determine exact angular positions of that outer knob. The relevant variable in such determination is the position, time is not a relevant factor. In the present invention however it was an insight that defining a small push, e.g. a small rotational movement of the knob as input code or motion pattern could be used instead of the exact angular position of the outer knob. In order to define the small push, or a complete or partial revolution it is suggested to use the sensor(s) in a way to determine a first, second, third or higher order time derivative of the angular position of the outer knob.

The present disclosed invention, in a second aspect, describes a lock system which consisting of at least; a first shaft which is mechanically connected to and/or integrated with a user-operated outer knob and which is mechanically connected to a mechatronic coupling module; a second shaft mechanically connected to and/or integrated with a door lock actuator element and mechanically connected to the mechatronic coupling module. Both shafts are positioned parallel and at least partially overlapping in the axial direction. A user-operated inner knob comprises of at least one inner knob housing, an energy accumulator element, the mechatronic coupling module and a wireless communication and control module which is arranged for wirelessly communication with a wireless communication apparatus, and controls the mechatronic coupling module. The mechatronic coupling module provides the lock system with an activation function by coupling and disengaging the inner knob with the first shaft and/or the second shaft depending on the design of the lock system or the state of the lock system, by control of both knobs or by control of one knob. The wireless communication and control module is electronically connected and/or integrated with at least one inertial sensor and/or relative motion sensor.

A lock system, in accordance with the second and/or the first aspect of the invention, has several advantages, amongst which;

- robust in operation because the door lock is ultimately operated by manual force;

- uses limited energy and therefore has a long battery lifetime because there is no electrical energy used for driving the door lock;

- has an increased resistance against typical tampering methods associated with mechatronic lock systems because of the asymmetric system architecture with the positioning of all electronic components safely in the inner knob;
- increases resistance against conventional mechanical tampering methods by applying a shaft over the full length of the cylinder lock, rim lock or deadbolt lock body.
- increases robustness against break failure by providing for a freely rotatable outer knob in the lock system inactive state;
- decreases overall cost and proneness to wear by limited complexity, limited miniaturization, applying electrical components only once and limiting the system architecture to two axles for operation;
- increases the ease-of-use by mechanically connecting both the inner and outer knob in the lock system's activated state.

With respect to the lock system architecture an important boundary condition is that the outer knob should remain solely mechanical. All electronic components shall be located in the inner knob. In addition, the outer knob shall only have one degree of freedom: rotation about a single axis.

Preferably, the proposed solution according to the first aspect is applicable to multiple embodiments of the lock system. It most preferably is applicable to both double and single controlled variants and preferably to a late-stage configurable version. It is important to understand that different variants result in the sub assembly being mechanically connected in a different manner and therewith rotating independently relative to the outer knob.

With respect to a preferred user interaction method the most important boundary condition is ease-of-use which can be divided in two aspects; easy to execute and an easy to interpret/learn.

The disclosed invention in its first aspect, proposes the sensing and matching of a sequence of rotational movements of the outer knob, in particular the determination of a first and/or second, and/or third, and/or higher order time-derivative of the angular position. Hence, being the derivative with respect to time of the position, velocity, acceleration, and in other words any one or more of, angular velocity ($\omega$), angular acceleration ($\alpha$) and angular jerk ($\zeta$).

The skilled person will appreciate that the absolute angular displacement ($\theta$) of the outer knob is not relevant for sensing and matching the motion pattern.

It is proposed to derive the required rotational motion pattern from an intellectual code with little chance of misinterpretation.

Code interpretations can differ but are all based on sensing rotational movement rather than rotational position of the outer knob.

Example code interpretations can be:

Directional modulated e.g. code '1234' means: 1 turn clockwise, 2 turns counter clockwise etc. this could involve a complete or partial revolution, or just a small push.

Intensity modulated e.g. code '1234' means: 1 hard turn, 2 soft turns etc.

A combination of different interpretations is also possible.

Based on the above example user interaction, sensors only positioned in

Time modulated e.g. code '1234' means: 1 short turn, 2 long turns etc.

With such a system, additional costs for the described function are limited to the cost of applying the necessary sensors. No electronics or linear moving parts have to be integrated in the outer knob. The total lock system therewith remains cost effective, robust in operation and secure against tampering. The required user actions are relatively simple to derive from an easy to share intellectual code. Various input methods are relatively unambiguous and involve little learning or interpretation from the user.

In an example, the lock system further comprises:

an inner knob assembly, arranged for control through rotation by a user of the lock system, and comprising the sensor and the control module.

In an example, the control module further comprises a wireless communication module for activating a mechatronic clutch (330) and therewith activating the lock system (100) for locking and unlocking the door.

In an example, the control module is configured to define the motion pattern based on any one or more of the group consisting of: angular velocity ($\omega$), angular acceleration ($\alpha$) and angular jerk ($\zeta$).

In an example, the sensor comprises a relative motion sensor and/or an inertial sensor, and wherein the sensor is configured for determining the first and/or higher order time derivative of the angular position of the outer knob.

In an example, the relative motion sensor being configured for determining the first and/or higher order time derivative of the angular position of the outer knob comprises any one or more of the group consisting of: an a capacitance sensor, Hall-effect sensor, ultrasonic sensor, opto-electronic sensor, micro cam switch, potentiometer, rotary encoder, magneto/reed switch, electromagnetic sensor.

In an example, the inertial sensor being configured for determining the first and/or higher order time derivative of the angular position of the outer knob comprises any one or more of the group consisting of: an accelerometer, a gyroscope, a magnetometer.

In an example, the defined motion pattern and/or the reference motion pattern is being defined by any one or more of a sequence of directional rotational position, sequence of time-modulated rotational position, sequence of velocity modulated rotational position, sequence of acceleration modulated rotational position, sequence of jerk modulated rotational position, sequence of snap modulated rotational position, sequence of crackle modulated rotational position or sequence of pop modulated rotational position.

In an example, the control module is arranged for programming the reference motion pattern by obtaining a reference motion pattern from the wireless communication module, and/or entering a programming modus wherein the control module is arranged to determine the motion pattern from the code sequence and storing the motion pattern as the reference motion pattern.

In an example, the control module is arranged for applying an expiry time on the reference motion pattern for defining a validity thereof, and wherein the expiry time, in particular, is defined by a predetermined time period initiated by a predetermined time stamp or first use of the system.

In an example, the system further comprises a biometric sensor for identification of the user by a biometric parameter, and in particular a heartbeat rate pattern.

In an example, the system further comprises a wireless communication device for identification of the user, the wireless communication device in particular comprising a key fob or a numeric keypad, RFID key/card/tag, wireless communication device, smartphone, smartwatch, mobile device, tablet, or portable computer/laptop.

In an example, the biometric sensor is comprised of a fingerprint scanner or heartbeat sensor.

In an example, the wireless communication device is arranged for communicating with a cellular telecommunication network and/or a WiFi network.

The above-mentioned and other features and advantages of the invention are illustrated in the following description with reference to the enclosed drawings which are provided by way of illustration only and which are not limitative to the present invention.

BRIEF DESCRIPTION OF DRAWINGS

FIG. 1. shows, in an illustrative manner, a lock system in accordance with the first and second aspect of the invention;

FIG. 2 shows, in an illustrative manner, an internal view of the lock system in accordance with the first and second aspect of the invention, in a double controlled variant;

FIG. 3 shows, in an illustrative manner, an internal view of the lock system in accordance with the first and second aspect of the invention, in a single controlled variant;

FIG. 4 schematically show four different examples of translating an intellectual code through a specific user actions in accordance with the first aspect of the invention.

DETAILED DESCRIPTION

FIG. 1 schematically shows the disclosed lock system (100) with its main interfaces; the outer knob (010), the inner knob assembly (030), the door lock operating cam (020) and two example wireless communication devices (510, 510'). In this case a key fob and a numeric keypad respectively.

FIG. 2 schematically shows the disclosed lock system (100) as a double controlled variant (001); the outer knob (010) and inner knob assembly (030) are mechanically connected to the first shaft (110). The door lock operating cam (020) is mechanically connected to the second shaft (210).

Both knobs (010, 030) are freely rotating relative to the cylinder housing (410) and the second shaft (210). The inner knob assembly (030) consists of an inner knob housing (310), a mechatronic clutch unit (330), a wireless control unit (340) and an energy accumulator (350). An inertial sensor (342) is depicted as part of the wireless control unit (340) electronics assembly. A predetermined or programmable motion pattern of the outer knob will be detected by the inertial sensor (342). After sensing and matching the motion pattern the wireless control unit (340) will activate the mechatronic clutch (330) coupling both shafts (110, 210) and therewith activate the lock system (100).

FIG. 3 schematically shows the disclosed lock system (100) in a single controlled variant (002); the outer knob (010) is mechanically connected to the first shaft (110). The door lock operating cam (020) and inner knob assembly (030) are mechanically connected to the second shaft (210). The outer knob (010) is freely rotating relative to the cylinder housing (410) and the inner knob assembly (030). The inner knob assembly (030) consists of a inner knob housing (310), a mechatronic clutch unit (330), a wireless control unit (340) and an energy accumulator (350). A relative motion sensor (341) is depicted wired to the wireless control unit (340) electronics assembly. A predetermined or programmable rotational motion pattern of the outer knob will be detected by the relative motion sensor (341). After sensing and matching the motion pattern the wireless control unit (340) will activate the mechatronic clutch (330) coupling both shafts (110, 210) and therewith activating the lock system (100).

FIG. 4*a-d* schematically show four different examples of translating the same intellectual code '1234' in specific user actions and therewith a specific motion pattern. As described it is technically not necessary to determine the absolute angular position or displacement ($\theta$) of the outer knob (030) at any instance to sense and match the motion pattern.

FIG. 4*a* schematically shows a user interaction using discrete movements of the outer knob in a specific angular direction. As time (t) passes the user turns the outer knob one time clockwise, two times counterclockwise, three times clockwise and finally four times counter clockwise. Every change of rotational/angular direction initiates a next number in the intellectual code.

FIG. 4*b* schematically shows a user interaction using time duration of discrete rotational movements of the outer knob. As time (t) passes the user gives a short turn followed by two long turns, three short turns and four long turns. The relative duration of different discrete turns is used to differentiate short and long turns and therewith derive the number inputs and numbers of the code itself.

FIG. 4*c* schematically shows a user interaction using the intensity of the discrete rotational movements of the outer knob. One soft turn is followed by two hard turns, three soft turns and four hard turns. Intensity can be determined as the measured value of, or a combination of; angular velocity ($\omega$), angular acceleration ($\alpha$) and angular jerk ($\zeta$). Turns with higher intensity are depicted as arrows with a variable line thickness.

FIG. 4*d* schematically shows a user interaction using a waiting time (tw) and feedback (f) from the lock system. The feedback can for example be audible visible or haptic. The process starts with one turn; user waits for feedback (f), two turns, (f), three turns, (f), four turns and acknowledgment feedback (fa).

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein.

More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein.

It is, therefore, to be understood that the foregoing embodiments are presented by way of example only and that, within the scope of the appended claims and equivalents thereto inventive embodiments may be practiced otherwise than as specifically described and claimed.

Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or"

as defined above. For example, when separating items in a list, "or" or "and/or" shall be interpreted as being inclusive, i.e., the inclusion of at least one, but also including more than one, of a number or list of elements, and, optionally, additional unlisted items.

Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements.

This definition also allows that elements may optionally be present other than the elements specifically identified within the list of elements to which the phrase "at least one" refers, whether related or unrelated to those elements specifically identified.

Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

The present disclosed invention is applicable to new lock designs as well as retrofitting conventional cylinder locks, deadbolt locks or rim locks. The present disclosed lock system is applicable in consumer home applications as well as professional applications including escape route use cases.

In the drawings, the following references are used:

001 Double Controlled Variant
002 Single Controlled Variant
010 Outer Knob
020 Door Lock Operating Cam
030 Inner Knob Assembly
100 Lock System
110 First Shaft
210 Second Shaft
310 Inner Knob Housing
330 Mechatronic Clutch
340 Wireless Control Unit
341 Relative Motion Sensor
342 Inertial Sensor
350 Energy Accumulator
410 Cylinder Housing
510 Wireless Communication Device

The invention claimed is:

1. A mechatronic lock system (100) arranged for actuating a door lock upon activation of said system comprising:

an outer knob (010), arranged for inputting a code sequence by a user of said lock system through rotation of said outer knob (010) to activate said system;

a sensor (341, 342), arranged for determining a rotational movement of said outer knob (010); and a control module (340) in communicative connection with said sensor (341, 342) and arranged for defining an input motion pattern from said rotational movement, and wherein said control module (340) is arranged for comparing said input motion pattern with a predetermined reference motion pattern and activating said system (100) upon a match between said input motion pattern and said reference motion pattern, and wherein said motion patterns comprise a first and/or higher order time derivative of angular displacement of said outer knob (010).

2. The mechatronic lock system (100) according to claim 1, said lock system further comprising:

an inner knob assembly (030), arranged for control through rotation by a user of said lock system, and comprising said sensor (341, 342) and said control module (340).

3. The mechatronic lock system (100) according to claim 1, wherein said control module further comprises a wireless communication module for activating a mechatronic clutch (330) and therewith activating the lock system (100) for actuating said door lock.

4. The mechatronic lock system (100) according to claim 1, wherein said control module is configured to define said motion pattern based on any one or more of the group consisting of: angular velocity ($\omega$), angular acceleration ($\alpha$) and angular jerk ($\zeta$).

5. The mechatronic lock system (100) according to claim 1, wherein said sensor comprises a relative motion sensor (341) and/or an inertial sensor (342), and wherein said sensor is configured for determining said first and/or higher order time derivative of the angular position of said outer knob (010).

6. The mechatronic lock system (100) according to claim 5, wherein said relative motion sensor (341) is configured for determining said first and/or higher order time derivative of the angular position of said outer knob (010), said relative motion sensor being selected from the group consisting of: a capacitance sensor, Hall-effect sensor, ultrasonic sensor, opto-electronic sensor, micro cam switch, potentiometer, rotary encoder, magneto/reed switch, electromagnetic sensor, and combinations thereof.

7. The mechatronic lock system (100) according to claim 5, wherein said inertial sensor (342) is configured for determining said first and/or higher order time derivative of the angular position of said outer knob (010), said inertial sensor being selected from the group consisting of: an accelerometer, a gyroscope, and a magnetometer.

8. The mechatronic lock system (100) according to claim 1, wherein said input motion pattern and/or said reference motion pattern is defined by any one or more of a sequence of directional rotational movement, sequence of time-modulated rotational movement, sequence of velocity modulated rotational movement, sequence of acceleration modulated rotational movement, or sequence of jerk modulated rotational movement.

9. The mechatronic lock system (100) according to claim 1, wherein said control module is arranged for programming said reference motion pattern by obtaining a reference motion pattern from said wireless communication module, and/or entering a programming modus wherein said control module is arranged to determine said motion pattern from said code sequence and storing said motion pattern as said reference motion pattern.

10. The mechatronic lock system (100) according to claim 1, wherein said control module is arranged for applying an expiry time on said reference motion pattern for defining a validity thereof, and wherein said expiry time is defined by a predetermined time period initiated by a predetermined time stamp or first use of said system.

11. The mechatronic lock system (100) according to claim 1, said system further comprising a biometric sensor for identification of said user by a biometric parameter including a heartbeat rate pattern.

12. The mechatronic lock system (100) according to claim 1, said system further comprising a wireless communication device (510, 510') for identification of said user, said wireless communication device comprising a key fob or a numeric keypad.

* * * * *